US006067047A

United States Patent [19]

Cook et al.

[11] Patent Number: 6,067,047

[45] Date of Patent: May 23, 2000

[54] ELECTRICALLY-CONTROLLABLE BACK-FED ANTENNA AND METHOD FOR USING SAME

[75] Inventors: Dean Lawrence Cook, Mesa; Kenneth Vern Buer, Gilbert; Deborah Sue Dendy, Tempe; David Warren Corman, Gilbert, all of Ariz.

[73] Assignee: Motorola, Inc., Schaumburg, Ill.

[21] Appl. No.: 08/980,251

[22] Filed: Nov. 28, 1997

[51] Int. Cl.[7] ..... H01Q 3/22; H01Q 3/24; H01Q 3/26

[52] U.S. Cl. ..... 342/372; 343/754; 343/778; 343/785; 333/156; 333/157

[58] Field of Search ..... 342/372; 343/754, 343/778, 785; 333/157, 156

[56] References Cited

U.S. PATENT DOCUMENTS

| | | | |
|---|---|---|---|
| 4,090,199 | 5/1978 | Archer | 343/100 SA |
| 4,575,727 | 3/1986 | Stern et al. | 343/768 |
| 5,309,166 | 5/1994 | Collier et al. | 343/778 |
| 5,334,958 | 8/1994 | Babbitt et al. | 333/156 |
| 5,349,363 | 9/1994 | Milroy | 373/772 |
| 5,361,076 | 11/1994 | Milroy | 343/772 |
| 5,412,394 | 5/1995 | Milroy | 343/785 |
| 5,469,165 | 11/1995 | Milroy | 342/13 |
| 5,472,935 | 12/1995 | Yandrofski et al. | 505/210 |
| 5,483,248 | 1/1996 | Milroy | 343/785 |
| 5,583,524 | 12/1996 | Milroy | 343/772 |
| 5,589,845 | 12/1996 | Yandrofski et al. | 343/909 |

FOREIGN PATENT DOCUMENTS

WO 9722158 6/1997 WIPO .

OTHER PUBLICATIONS

Brookner, E., "Major Advances in Phased Arrays: Part II", Microwave Journal, Jun. 1997, pp. 84, 86, 88, 91, 92.

*Primary Examiner*—Theodore M. Blum
*Attorney, Agent, or Firm*—James E. Klekotka

[57] ABSTRACT

A user terminal (110) which comprises an electrically-controllable back-fed antenna (300, FIG. 3) is used for the formation of single and multiple beams. The electrically-controllable back-fed antenna comprises an RF power distribution/combination network (310), electrically-controllable phase-shifting elements (320), a control network (440, FIG. 4) and radiating/receiving elements (360). The control network is coupled to the electrically-controllable phase-shifting elements and is used for controlling the dielectric constant of dielectric material contained within the electrically-controllable phase-shifting elements. In a preferred embodiment, phase-shifting elements comprise waveguide sections containing at least one dielectric material, and the dielectric material includes a ferroelectric material, preferably comprising Barium Strontium Titanate (BST).

19 Claims, 3 Drawing Sheets

ELECTRICALLY-CONTROLLABLE BACK-FED ANTENNA AND METHOD FOR USING SAME

FIELD OF THE INVENTION

This invention relates generally to antennas and, more particularly, to an electrically-controllable back-fed antenna and method for using same.

BACKGROUND OF THE INVENTION

While various problems associated with the inefficient use of network resources plague a wide variety of communication networks, they have more serious consequences in networks which rely on radio frequency (RF) communication links.

Space-based and terrestrial-based communication systems must share a limited frequency spectrum. The need to constantly increase the capacity of space-based and terrestrial-based communications systems has resulted in the continuing evolution of antenna technology. Antennas can provide multiple beams using spatial and/or polarization isolation techniques. Advances are still required to provide enhanced performance with respect to antennas generating adaptive antenna beam patterns. Adaptive antenna patterns have been generated using a variety of active and passive phased arrays.

Communication systems have used phased array antennas to communicate with multiple users through multiple antenna beams. Typically, efficient bandwidth modulation techniques are combined with multiple access techniques, and frequency separation methods are employed to increase the number of users.

Increased efficiency can be obtained by improving the antenna being used for an RF communication link. Furthermore, there is no known low cost phased array topology practical at microwave and/or millimeter wave frequencies for forming simultaneous multiple beams from a single aperture.

Accordingly, a need exists to form simultaneous independently steerable multiple beams in a low cost phased array antenna that is practical at microwave and/or millimeter wave frequencies.

In particular, there is a significant need for apparatus and methods for providing multiple beams from a single antenna which can be independently steered over a wide angle field of view.

BRIEF DESCRIPTION OF THE DRAWINGS

A more complete understanding of the present invention can be derived by referring to the detailed description and claims when considered in connection with the figures, wherein like reference numbers refer to similar items throughout the figures, and:

DETAILED DESCRIPTION OF A PREFERRED EMBODIMENT

Figure 1:
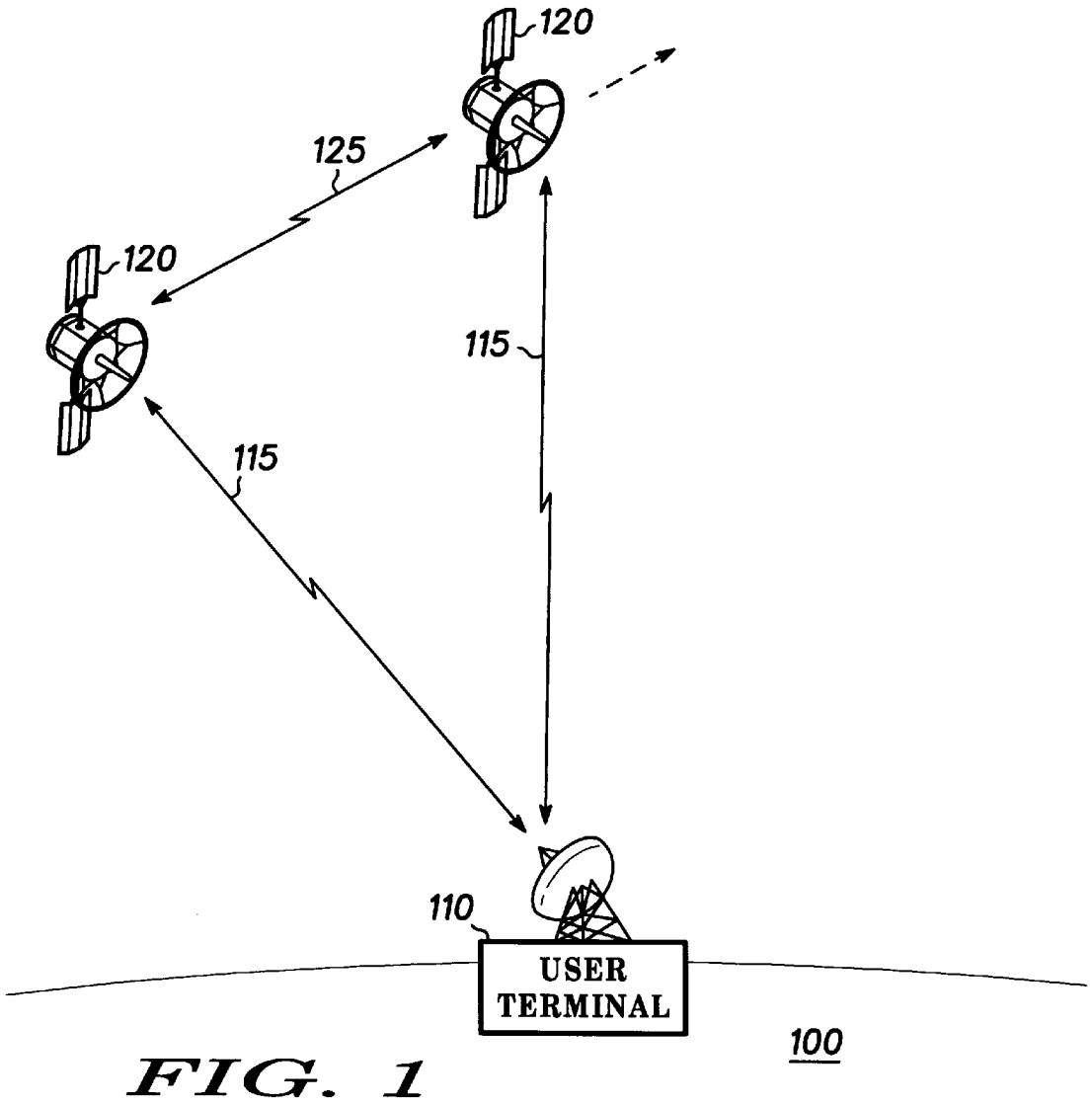
FIG. 1 shows a general view of a satellite communication system according to a preferred embodiment of the invention.

FIG. 1 shows a general view of satellite communication system 100 according to a preferred embodiment of the invention. Communication system 100 comprises at least one user terminal 110 and a plurality of satellites 120. Generally, communication system 100 can be viewed as a network of nodes. All nodes of communication system 100 are or can be in data communication with other nodes of communication system 100 through communication links (115 and 125). In addition, all nodes of communication system 100 are or can be in data communication with other devices dispersed throughout the world through terrestrial networks and/or other conventional terrestrial user terminals coupled to communication system 100 through user terminals 110.

The present invention is applicable to satellite communication systems that use multiple beams, which are pointed towards the earth, and preferably, to satellite communication systems that move beams across the surface of the earth. Also, the invention is applicable to satellite communication systems having at least one satellite in a non-geosynchronous orbit or geosynchronous orbit around earth. There can be a single satellite or many satellites in a constellation of satellites orbiting the earth. The invention is also applicable to satellite communication systems having satellites which orbit the earth at any angle of inclination including polar, equatorial, inclined or other orbital patterns. The invention is also applicable to systems where full coverage of the earth is not achieved. The invention is also applicable to systems where plural coverage of portions of the earth occurs (e.g., more than one satellite is in view of a particular point on the earth's surface).

Each satellite 120 communicates with other adjacent satellites 120 through cross-links 125. These cross-links form a backbone in satellite communication system 100. Thus, data from one user terminal 110 located on or near the surface of the earth can be routed through a satellite or a constellation of satellites to within range of substantially any other point on the surface of the earth.

User terminals 110 can be located at various points on the surface of earth or in the atmosphere above earth. Communication system 100 can accommodate any number of user terminals 110. User terminals 110 are preferably user terminals capable of transmitting and/or receiving data from satellites 120. By way of example, user terminals 110 may be located on individual buildings or homes. Moreover, user terminals 110 can comprise computers capable of sending email messages, video transmitters or facsimile machines. In a preferred embodiment, user terminals 110 have been adapted to use at least one electrically-controllable back-fed antenna as described below.

In a preferred embodiment of the invention, user terminals 110 communicate with nearby satellites 120 through data links 115. Links 115 encompass a limited portion of the electromagnetic spectrum that is divided into numerous channels. Links 115 are preferably K-Band, but alternate embodiments may use L-Band, S-band, or any other microwave frequencies. Links 115 can encompass Frequency Division Multiple Access (FDMA) and/or Time Division Multiple Access (TDMA) and/or Code Division Multiple Access (CDMA) communication channels or combinations thereof.

Figure 2:
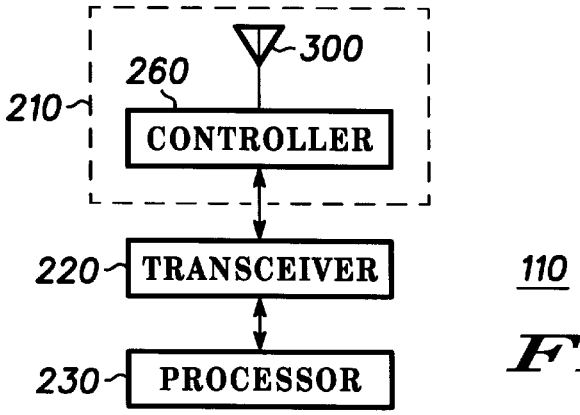
FIG. 2 shows a simplified block diagram of a user terminal in accordance with a preferred embodiment of the invention.

FIG. 2 shows a simplified block diagram of a user terminal in accordance with a preferred embodiment of the invention. User terminal 110 comprises at least one antenna subsystem 210, at least one transceiver 220 which is coupled to antenna subsystem 210 and at least one processor 230 which is coupled to transceiver 220. Antenna subsystem 210 comprises at least one electrically-controllable back-fed antenna 300 and at least one controller 260 which is coupled to electrically-controllable back-fed antenna 300.

Electrically-controllable back-fed antenna 300 (as illustrated) is coupled to transceiver 220. Controller 260 (as illustrated) is coupled to processor 230. Controller 260 implements the necessary control functions which cause electrically-controllable back-fed antenna 300 to form antenna beams with the desired characteristics.

RF signals are transferred between electrically-controllable back-fed antenna 300 and transceiver 220. Although the signal path is illustrated as a single line, many interconnections are possible between electrically-controllable back-fed antenna 300 and transceiver 220.

Digital data signals are transferred between controller 260 and electrically-controllable back-fed antenna 300. In the receive mode, transceiver 220 converts RF signals received from electrically-controllable back-fed antenna 300 into digital data. In the transmit mode, transceiver 220 converts digital data obtained from processor 230 into RF signals. RF signals are sent to electrically-controllable back-fed antenna 300 by transceiver 220.

Control signals are transferred between controller 260 and processor 230. Digital data signals are also transferred between processor 230 and transceiver 220. RF signals received by transceiver 220 are converted to digital data which is sent to processor 230 to be further processed.

Electrically-controllable back-fed antenna 300 includes elements (not shown in FIG. 2) preferably arranged in a two-dimensional array. However, other array configurations are suitable.

Figure 3:
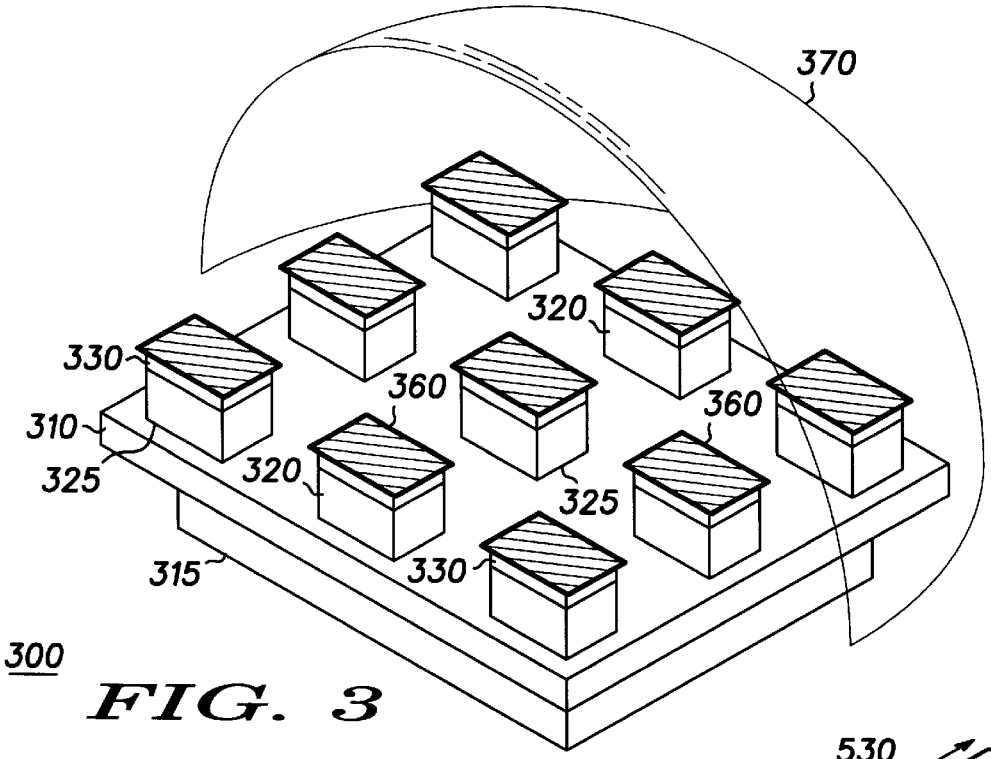
FIG. 3 illustrates a simplified view of an electrically-controllable back-fed antenna in accordance with a preferred embodiment of the invention.

FIG. 3 illustrates a simplified view of an electrically-controllable back-fed antenna in accordance with a preferred embodiment of the invention. Electrically-controllable back-fed antenna 300 comprises RF power distribution network having at least one RF input 315 and a plurality of RF outputs 325. RF power distribution network 310 divides the RF power received at one or more RF inputs into substantially equal parts and distributes these substantially equal parts to a plurality of RF outputs 325 using a back-feed configuration. Electrically-controllable back-fed antenna 300 also comprises a plurality of electrically-controllable phase-shifting elements 320 that are coupled to RF outputs 325 on RF power distribution network 310. In a preferred embodiment, the electrically-controllable phase-shifting elements 320 are waveguide sections filled with at least one dielectric material. In a preferred emnbodiment, the dielectric material includes a ferroelectric material, preferably comprising Barium Strontium Titanate (BST).

Figure 4:
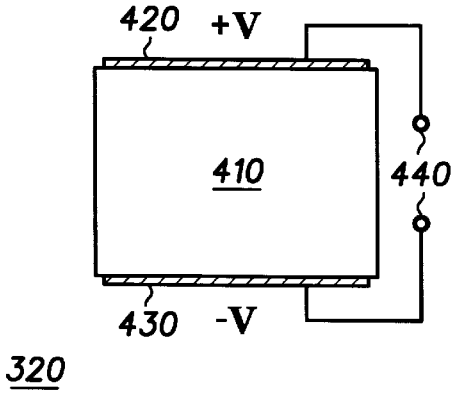
FIG. 4 illustrates a top view of a phase shift element for use in an electrically-controllable back-fed antenna in accordance with a preferred embodiment of the invention.

Also, electrically-controllable back-fed antenna 300 comprises a control network (two conductors of which are shown in FIG. 4) that is coupled to electrically-controllable phase-shifting elements 320 and is used for controlling the dielectric constant of the dielectric material. Changing the dielectric constant causes a corresponding phase shift to occur. It will be apparent to one skilled in the art that the control network comprises suitable electronics which are controlled by controller (260, FIG.2) for applying the desired fields to the plurality of electrically-controllable phase-shifting elements 320.

In addition, electrically-controllable back-fed antenna 300 comprises a plurality of antenna array elements 360 that are coupled to electrically-controllable phase-shifting elements 320. In a preferred embodiment, electrically-controllable phase-shifting elements 320 and antenna array elements 360 are rectangularly shaped.

In a preferred embodiment, a dielectric matching layer 330 is used between phase-shifting elements 320 and antenna array elements 360. A dielectric matching layer is used to minimize reflections. In a preferred embodiment, the dielectric matching layer has a thickness that is approximately one quarter wavelength. In addition, the matching layer desirably has a dielectric constant which is approximately equal to the square root of the dielectric constant of the ferroelectric material. The dielectric constant for the matching layer is calculated using the geometric mean of the relative dielectric constants of the two media.

In a preferred embodiment, radome 370 is used to cover and protect electrically-controllable back-fed antenna 300. In an alternate embodiment, radome 370 is not used.

In alternate embodiments, antenna array elements 360 can be grouped together in rows and/or columns, and these rows and/or columns can be controlled individually or as groups. In other embodiments, antenna array elements 360 can have different shapes than those illustrated in FIG. 3. For example, antenna array elements 360 can have square, rectangular, or polygonal shapes. Circles and/or ellipses can also be used. In other alternate embodiments, the number of antenna array elements 360 can be changed. For example, a simple antenna can comprise a single antenna array element 360, and this single antenna array element 360 can have a variety of shapes.

In a preferred embodiment of the invention, antenna array elements 360 do not touch each other. Quarter-wavelength gaps are used between antenna array elements 360. In alternate embodiments, quarter-wavelength gaps may or may not be present between the individual regions. In addition, these gaps can vary in size and shape.

In a preferred embodiment, RF power distribution network 310 comprises a waveguide structure. In one alternate embodiment, RF power distribution network 310 comprises a stripline structure. In another embodiment, RF power distribution network 310 comprises a plurality of power dividers.

In a preferred embodiment, antenna array elements 360 form at least one flat surface. In one alternate embodiment, antenna array elements 360 form at least one curved surface. In another embodiment, antenna array elements 360 form a linear pattern.

In a preferred embodiment, antenna array elements 360 form at least one two-dimensional array. In other embodiments, antenna array elements 360 form at least one three-dimensional array.

In a preferred embodiment, antenna array elements 360 have a regular geometric shape. In other embodiments, antenna array elements 360 have at least one irregular geometric shape.

In a preferred embodiment, electrically-controllable phase-shifting elements 320 have regular geometric shapes (e.g., rectangles, circles, ellipses, etc.). In other embodiments, electrically-controllable phase-shifting elements 320 have at least one irregular geometric shape.

In a preferred embodiment, electrically-controllable phase-shifting elements 320 have the same length. In other embodiments, electrically-controllable phase-shifting elements 320 have different lengths.

In a preferred embodiment, electrically-controllable back-fed antenna 300 comprises a plurality of array elements which are independently controlled to produce the desired phase relationship to steer the antenna beams in any direction over a wide angle field of view. This steering is accomplished by applying control voltages to electrically-controllable phase-shifting elements 320, and this allows antenna beams to be changed faster than a mechanical configuration.

In addition, electrically-controllable back-fed antenna 300 has advantages over conventional fixed beam antennas because it can, among other things, provide greater viewing angles, adaptively adjust antenna beam patterns, provide antenna beams to individual satellites, provide antenna beams in response to demand for communication services and improve pattern nulling of unwanted RF signals.

FIG. 4 illustrates a top view of a phase shift element for use in an electrically-controllable back-fed antenna in accordance with a preferred embodiment of the invention. Phase shift element 320 comprises a block of dielectric material 410, first conducting layer 420 on one side of the block of dielectric material 410, a second conducting layer 430 on an opposing side of the block of dielectric material 410, and control network 440.

In a preferred embodiment, electrically-controllable dielectric material 410 comprises a voltage-variable dielectric material. Voltage-variable dielectric material has a dielectric constant which changes in response to a direct current (DC) voltage that is applied to the dielectric material. In an alternate embodiment, electrically-controllable dielectric material 410 comprises a current-variable dielectric material. Current-variable dielectric material has a dielectric constant which changes in response to a DC current that is applied to the dielectric material.

In a preferred embodiment, first conducting layer 420 and second conducting layer are electrical conductors, desirably a metal. First conducting layer 420 and second conducting layer 430 are used to provide the electrodes needed to establish an electric field across dielectric material 410. First conducting layer 420 and second conducting layer 430 are substantially continuous layers. First conducting layer 420 or second conducting layer 430 can be maintained at a single potential such as ground.

In an alternate embodiment, first conducting layer 420 and/or second conducting layer 430 can comprise a plurality of individual elements. In this case, these individual elements are attached to a side of the block of dielectric material to form an array. In this case, a non-uniform or segmented field can be established across the dielectric material.

In alternate embodiments, multiple phase shift elements such as element 320 are grouped together in rows and/or columns, and these rows and/or columns are controlled individually or as groups. Superposition can be employed to provide each element a unique voltage and/or current required for the proper RF phase shift.

In alternate embodiments of the invention, individual phase shift elements 320 can have different shapes from those illustrated in FIG. 3 and FIG. 4. For example, individual phase shift elements 320 can have square, rectangular, or polygonal shapes. Circular and/or elliptical shapes can also be used. In other alternate embodiments, the number of phase shift elements 320 can be changed from that illustrated. For example, a simple antenna can comprise a single phase shift element 320, and this single element can have a variety of shapes.

In a preferred embodiment of the invention, individual phase shift elements 320 do not touch each other. Gaps are used to allow the placement of electrodes and control circuitry.

Figure 5:
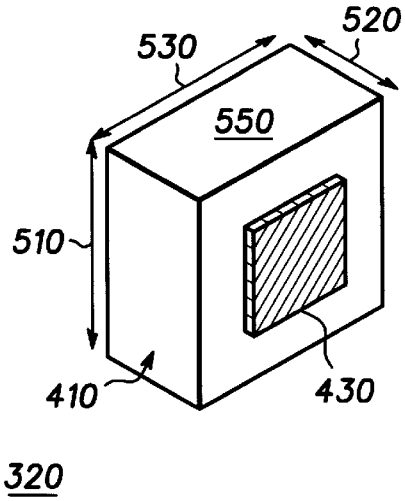
FIG. 5 illustrates a perspective view of a phase shift element for use in an electrically-controllable back-fed antenna in accordance with a preferred embodiment of the invention.

FIG. 5 illustrates a perspective view of a phase shift element for use in an electrically-controllable back-fed antenna in accordance with a preferred embodiment of the invention. Phase shift element 320 has length 510, width 520, depth 530, and top surface 550. In a preferred embodiment, antenna array element 360 (FIG. 3) is larger than top surface 550. In an alternate embodiment, antenna array element 360 has the same area or a smaller area than top surface 550.

In a preferred embodiment, phase shift element 320 is formed from dielectric material 410 comprising a single type of electrically-controllable dielectric material. In alternate embodiments of the invention, the entire block does not contain the same type of electrically-controllable dielectric material. For example, one area is filled with a first material, and another area is filled with a second material.

Figure 6:
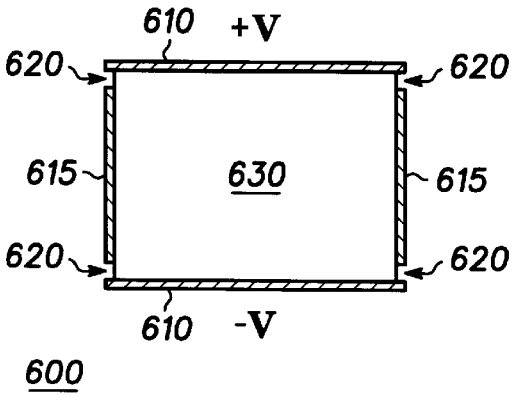
FIG. 6 shows a top view of a phase shift element constructed using a rectangular waveguide for use in an electrically-controllable back-fed antenna in accordance with an alternate embodiment of the invention.

FIG. 6 shows a top view of a phase shift element constructed using a rectangular waveguide for use in an electrically-controllable back-fed antenna in accordance with an alternate embodiment of the invention. Rectangular waveguide has two pairs of parallel sides 610 and 615 which are isolated (with respect to DC) due to slots 620. Two sides 610 are used to provide an electric field across dielectric material 630. Dielectric material 630 has a substantially uniform dielectric constant within rectangular waveguide 600. Dielectric material 630 substantially fills rectangular waveguide 600. In alternate embodiments, rectangular waveguide 600 is not filled completely, and/or it contains one or more dielectric materials.

Figure 7:
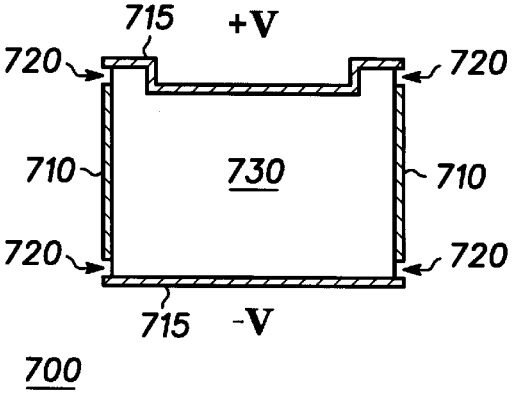
FIG. 7 shows a top view of a phase shift element constructed using a ridged waveguide for use in an electrically-controllable back-fed antenna in accordance with an alternate embodiment of the invention.

FIG. 7 shows a top view of a phase shift element constructed using a ridged waveguide for use in an electrically-controllable back-fed antenna in accordance with an alternate embodiment of the invention. Ridged waveguide has a pair of parallel sides 710 and a pair of sides 715 at least one of which is ridged. These pairs of parallel sides are isolated (with respect to DC) due to slots 720. Two sides 715 are used to provide an electric field across dielectric material 730. Ridged waveguide 700 is used so that a lower voltage can be used to change the dielectric constant of the dielectric material. Dielectric material 730 has a substantially uniform dielectric constant within ridged waveguide 700. Dielectric material 730 substantially fills ridged waveguide 700. In alternate embodiments, ridged waveguide 700 is not filled completely, and/or it contains one or more dielectric materials.

In other alternate embodiments of the invention, waveguides can have different shapes than those illustrated in FIG. 6 and FIG. 7. For example, circular waveguides can also be used.

Figure 8:
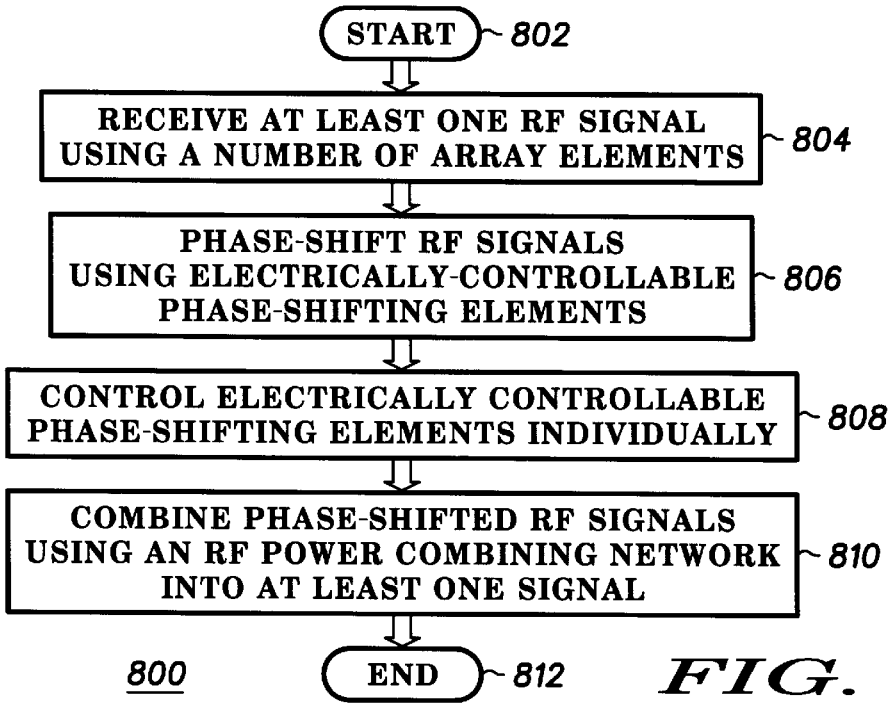
FIG. 8 illustrates a flowchart of a method for using an electrically adjustable back-fed RF antenna in accordance with a preferred embodiment of the invention.

FIG. 8 illustrates a flowchart of a method for using an electrically adjustable back-fed RF antenna in accordance with a preferred embodiment of the invention. An electrically adjustable back-fed RF antenna can be used for forming at least one RF output signal from a plurality of received signals. Procedure 800 starts with step 802. Initiation of procedure 800 can be the result of a user initiation message, such as turn-on, or can be the result of a satellite transmitting a signal.

In step 804, at least one RF signal is received by a number of receiving elements which are used in an array antenna. In step 806, the signals received by the receiving elements are phase-shifted using a plurality of electrically-controllable phase-shifting elements which are coupled to the plurality of receiving elements. In step 808, the phase-shifting is controlled using control network (440, FIG. 4) which is coupled to the plurality of electrically-controllable phase-shifting elements. The phase shifting is controlled by controlling the dielectric constants of the dielectric materials used in the plurality of electrically-controllable phase-shifting elements.

In step 810, after the RF signals have been phase-shifted, they are combined using an RF power combining network that has at least one RF output and a plurality of RF inputs. The RF power combining network combines RF power received at a plurality of RF inputs which are coupled to the plurality of electrically-controllable phase-shifting elements to provide at least one combined signal at the RF output. Procedure 800 ends in step 812.

Figure 9:
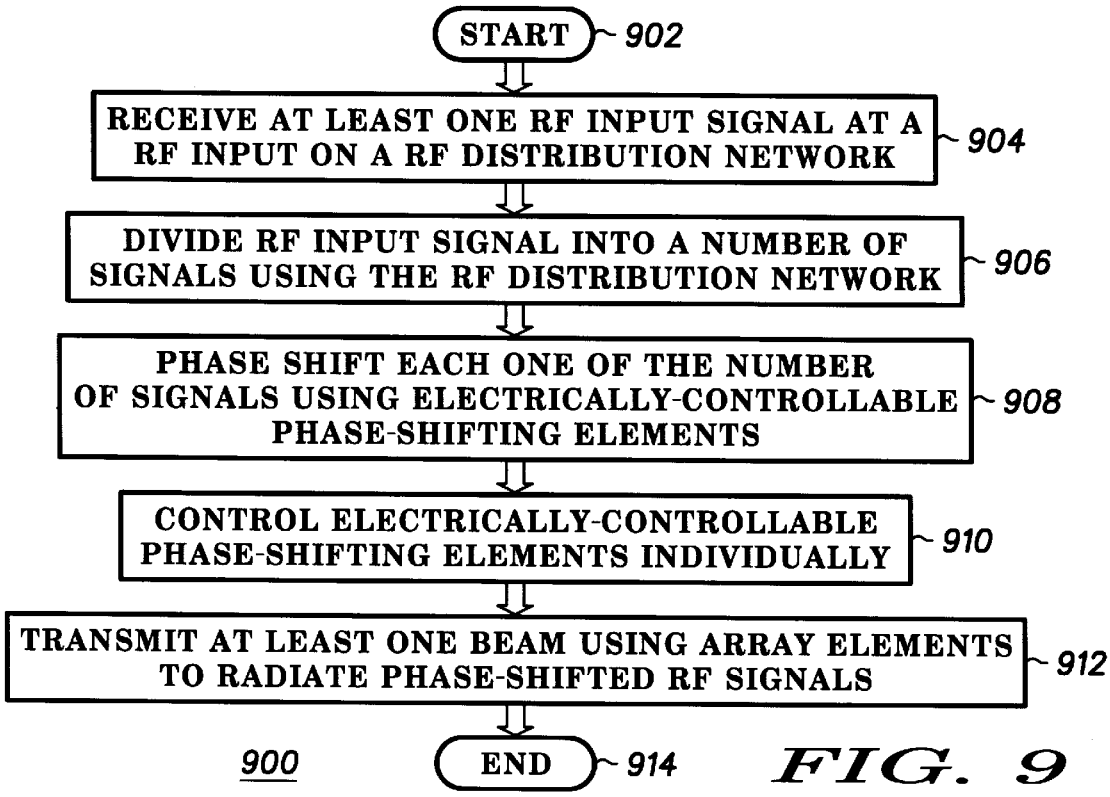
FIG. 9 illustrates a flowchart of an alternate method for using an electrically adjustable back-fed RF antenna in accordance with an alternate embodiment of the invention.

FIG. 9 illustrates a flowchart of an alternate method for using an electrically adjustable back-fed RF antenna in accordance with an alternate embodiment of the invention. An electrically adjustable back-fed RF antenna can be used for forming at least one beam. The beam is formed using a number of signals radiated by a plurality of antenna array elements. Procedure 900 starts with step 902. Initiation of procedure 900 can be the result of a user initiation message, such as turn-on, or can be the result of an initiation signal from a control center.

In step 904, an RF input signal is received at an RF input port of an RF distribution network. In step 906, the RF distribution network divides the RF input signal into a plurality of substantially equal RF signals. In step 908, these substantially equal RF signals are individually phase-shifted using a plurality of electrically-controllable phase-shifting elements that are coupled to a plurality of outputs on the RF distribution network.

In step 910, the phase-shifting is controlled using control network (440, FIG. 4) which is coupled to the plurality of electrically-controllable phase-shifting elements. The phase shifting is controlled by controlling the dielectric constants of the dielectric materials used in the plurality of electrically-controllable phase-shifting elements.

In step 912, after the RF signals have been phase-shifted they are provided to a plurality of radiating elements which are coupled to the plurality of electrically-controllable phase-shifting elements. The radiating elements are used to transmit at least one beam. Procedure 900 ends in step 912.

Using the apparatus and methods of the invention, an antenna beam pattern radiated from a user terminal has at least one main beam directed toward a desired direction. In addition, one or more nulls can be directed at interfering signals which are within the field of view of the antenna.

Any or all of elements in an electrically-controllable back-fed antenna can be turned on or turned off. In addition, the pattern of the antenna can be steered by applying phase weighting across the individual elements in the electrically-controllable back-fed antenna. The receive and transmit patterns can be shaped by controlling the phase-shifting elements. Wider viewing angles, reduced interference, and improved beam steering can be achieved through the use of an electrically-controllable back-fed antenna.

One of the main advantages of an electrically-controllable back-fed antenna lies in the flexibility the antenna provides for the system. Many different algorithms can be used to compute the antenna patterns and the associated control signals.

The apparatus and methods of the invention enable the user terminals in a communication system to adaptively change antenna radiation patterns. This is accomplished both in the transmit and receive modes. Beam widths can be reduced, and nulls can be varied to minimize the effect of interfering signals using an electrically-controllable back-fed antenna.

The invention has been described above with reference to a preferred embodiment. However, those skilled in the art will recognize that changes and modifications can be made in this embodiment without departing from the scope of the invention. For example, while a preferred embodiment has been described in terms of using a specific implementation for an electrically-controllable back-fed antenna, other systems can be envisioned which use different implementations. Accordingly, these and other changes and modifications which are obvious to those skilled in the art are intended to be included within the scope of the invention.

What is claimed is:

1. An electrically adjustable back-fed radio frequency (RF) antenna comprising:

an RF power distribution network having at least one RF input and a plurality of RF outputs, wherein said RF power distribution network distributes RF power received at said at least one RF input into substantially equal parts to said plurality of RF outputs;

a plurality of electrically-controllable phase-shifting elements coupled to said plurality of RF outputs on said RF power distribution network, said plurality of electrically-controllable phase-shifting elements, wherein an electrically-controllable phase-shifting element comprises at least one waveguide structure comprising at least one dielectric material and two pairs of parallel sides which are direct current (DC) isolated from each other;

a control network coupled to a first pair of said parallel sides, said control network applying an electric field to said first pair of parallel sides for controlling a dielectric constant of said at least one dielectric material; and a plurality of antenna array elements coupled to said plurality of electrically-controllable phase-shifting elements, wherein dielectric matching layers are inserted between said plurality of electrically-controllable phase-shifting elements and said plurality of antenna array elements.

2. The electrically adjustable back-fed RF antenna as claimed in claim 1, wherein said RF power distribution network comprises a waveguide structure.

3. The electrically adjustable back-fed RF antenna as claimed in claim 1, wherein said RF power distribution network comprises a stripline structure.

4. The electrically adjustable back-fed RF antenna as claimed in claim 1, wherein said RF power distribution network comprises a plurality of power dividers.

5. The electrically adjustable back-fed RF antenna as claimed in claim 1, wherein said plurality of antenna array elements comprise radiating elements.

6. The electrically adjustable back-fed RF antenna as claimed in claim 1, wherein said plurality of antenna array elements comprise receiving elements.

7. The electrically adjustable back-fed RF antenna as claimed in claim 1, wherein said plurality of antenna array elements form at least one flat surface.

8. The electrically adjustable back-fed RF antenna as claimed in claim 1, wherein said plurality of antenna array elements form at least one curved surface.

9. The electrically adjustable back-fed RF antenna as claimed in claim 1, wherein said plurality of antenna array elements form a linear pattern.

10. The electrically adjustable back-fed RF antenna as claimed in claim 1, wherein said plurality of antenna array elements form at least one two-dimensional array.

11. The electrically adjustable back-fed RF antenna as claimed in claim 1, wherein said plurality of antenna array elements form at least one three-dimensional array.

12. The electrically adjustable back-fed RF antenna as claimed in claim 1, wherein said plurality of antenna array elements have a regular geometric shape.

13. The electrically adjustable back-fed RF antenna as claimed in claim 1, wherein said plurality of antenna array elements have an irregular geometric shape.

14. The electrically adjustable back-fed RF antenna as claimed in claim 1, wherein said plurality of electrically-controllable phase-shifting elements have identical length.

15. The electrically adjustable back-fed RF antenna as claimed in claim 1, wherein said plurality of electrically-controllable phase-shifting elements have different lengths.

16. The electrically adjustable back-fed RF antenna as claimed in claim 1, wherein said at least one dielectric material in said plurality of electrically-controllable phase-shifting elements comprises voltage-variable dielectric material.

17. The electrically adjustable back-fed RF antenna as claimed in claim 1, wherein said at least one dielectric material in said plurality of electrically-controllable phase-shifting elements comprises current-variable dielectric material.

18. An electrically-controllable phase-shifting element for steering beams in an electrically adjustable back-fed RF antenna, said electrically-controllable phase-shifting element comprising:

a block of dielectric material having a dielectric matching layer attached thereto;

a first conducting layer attached to said block on a first surfaces; and a second conducting layer attached to said block on a second surface, wherein said second surface is substantially opposite said first surface, said first conducting layer and said second conducting layer being used to establish an electric field across a first portion of said block of dielectric material, wherein said first conducting layer and said second conducting layer are a pair of waveguide walls.

19. The electrically-controllable phase-shifting element as claimed in claim 18, wherein said block of dielectric material includes a ferroelectric material comprising Barium Strontium Titanate (BST).

* * * * *